United States Patent [19]

Vratny et al.

[11] 4,319,967

[45] Mar. 16, 1982

[54] FABRICATION OF PALLADIUM ANODE FOR X-RAY LITHOGRAPHY

[75] Inventor: Frederick Vratny, Berkeley Heights, John M. Andrews, Jr., Watchung, both of N.J.

[73] Assignee: Bell Telephone Laboratories, Incorporated, Murray Hill, N.J.

[21] Appl. No.: 90,422

[22] Filed: Nov. 1, 1979

[51] Int. Cl.[3] ..... C25D 5/10; C25D 5/34; C25D 5/50

[52] U.S. Cl. ..... 204/29; 204/37 R; 204/40

[58] Field of Search ..... 204/29, 32 R, 37 R, 204/37 T, 40, 41

[56] References Cited

U.S. PATENT DOCUMENTS

| | | | |
|---|---|---|---|
| 3,133,005 | 5/1964 | Ades | 204/38 |
| 3,540,988 | 11/1970 | Wells et al. | 204/24 |
| 3,947,331 | 3/1976 | Kinh et al. | 204/37 R |
| 4,088,547 | 5/1978 | Albertson | 204/32 R |

OTHER PUBLICATIONS

Frederick Lowenheim, *Electroplating*, McGraw-Hill, New York, 1978, pp. 93-98.

Metal Finishing Guidebook and Directory 1978, Metals and Plastics Publications, Hackensack, N.J., pp. 18, 28-29.

J. B. Mohler, Finishing Pointer-Flash Plating, *Metal Finishing*, May 1979, p. 114.

*Primary Examiner*—Delbert E. Gantz
*Assistant Examiner*—William Leader
*Attorney, Agent, or Firm*—Lucian C. Canepa

[57] ABSTRACT

A fabrication process for making palladium-plated target anodes for X-ray lithographic systems is characterized by a unique sequence of surface preparation, plating and annealing steps. Anodes made by the process have been operated reliably at high-power levels for extended periods of time.

7 Claims, No Drawings

FABRICATION OF PALLADIUM ANODE FOR X-RAY LITHOGRAPHY

BACKGROUND OF THE INVENTION

This invention relates to metal plating and, more particularly, to fabrication procedures for preparing plated target anodes for X-ray generators.

X-ray generators are utilized in a variety of applications of practical importance. One significant area in which such sources are employed is the field of X-ray lithography. An advantageous X-ray lithographic system utilized to make structures such as large-scale-integrated (LSI) semiconductor devices is described in *IEEE Transactions on Electron Devices,* Vol. ED-22, No. 7, July 1975, pages 429–433. In an attempt to increase the throughput of such an X-ray lithographic system, efforts have been directed at trying to increase the power output of the X-ray generator included therein.

X-ray generators comprising rotating or stationary plated target anodes are available for use in lithographic systems. However, reliability problems arising from high power operation of such anodes have made generators of the plated type unattractive for many practical lithographic applications. In particular, interdiffusion effects and microcracks due to thermal stresses have limited the high-power reliability of plated anodes as heretofore constructed. Accordingly, efforts by workers in the lithographic field have been directed at trying to devise a reliable high-power X-ray source of the plated anode type characterized by high stability and long lifetime. It was recognized that such a source, if available, could be a basis for a rugged production-type X-ray lithographic system exhibiting advantageous throughput properties.

SUMMARY OF THE INVENTION

Hence, an object of the present invention is a plated member especially adapted for use as a high-power source in an X-ray lithographic system. More specifically, an object of this invention is a fabrication sequence for making a plated target anode for a high-power X-ray source to insure reliable operation of the source over a relatively long period of time.

Briefly, these and other objects of the present invention are realized in a specific illustrative fabrication sequence for preparing a palladium-plated target anode for use in an X-ray lithographic system. In one particular embodiment, the sequence comprises the initial step of polishing the surface of a copper substrate to a mirror finish having a relatively low grain boundary density. The substrate is then annealed to relieve polishing-induced stresses therein. Next, a relatively thin initial layer of palladium is flash plated on the surface of the substrate. Then, at a reduced current density, additional palladium is plated on the substrate surface to insure well-defined low-stress grain growth of the palladium to a thickness less than the final desired palladium thickness. Subsequently, the plated substrate is annealed to relieve stresses in the palladium layer and to insure good adhesion between the layer and the surface of the underlying substrate. Next, at the reduced current density, additional palladium is plated to achieve the final desired thickness thereof. Finally, the plated substrate is annealed to reduce the grain boundary density of the palladium layer at the copper-palladium interface and to relieve stressses in the palladium layer.

DETAILED DESCRIPTION

In accordance with the principles of the present invention, a metallic layer is plated on a metallic substrate. Herein, for purposes of a specific illustrative example, emphasis will be directed to plating a palladium layer on a copper substrate. But it is to be understood that applicant's inventive techniques are also applicable to other combinations of metals. Thus, for example, these techniques can be applied to plating palladium on gold or palladium on molybdenum.

Moreover, although the palladium-plated copper substrates specified herein are emphasized as having particular utility as target anodes in X-ray lithographic systems, it is to be understood that such a metallic combination is useful in other applications. For example, palladium-plated copper can be employed to form contact regions in switch structures or to form bonding regions on printed-circuit boards or integrated-circuit chips. When made in accordance with the principles of this invention, such plated regions exhibit highly reliable electrical and mechanical operating properties over an extended period of time.

Palladium-plated copper made in accordance with the fabrication techniques specified herein may, for example, be utilized to form a rotating water-cooled X-ray target anode of the type described in a copending commonly assigned application designated R. E. Dean-D. Maydan-J. M. Moran-G. N. Taylor Ser. No. 857,380, filed Dec. 5, 1977, now U.S. Pat. No. 4,185,202. Such an anode comprises a continuous strip of copper coated on one main surface thereof with a layer of palladium. Alternatively, applicant's techniques are also applicable to fabricating a stationary water-cooled X-ray target anode of the general type described in a copending commonly assigned application of J. R. Maldonado, Ser. No. 35,472, filed May 3, 1979, now U.S. Pat. No. 4,258,262. The particular stationary anode in the Maldonado application comprises a conical element made entirely of palladium. A conically shaped palladium-plated copper anode made in accordance with the procedures specified herein can be substituted for the Maldonado anode.

In accordance with the principles of the present invention, a specific illustrative anode of the aforementioned rotating type is prepared by initially fine machine finishing a suitably shaped strip of 500-micrometer ($\mu$m)-thick oxygen-free high-conductivity copper stock. As a result of this machining step, the strip thickness is typically reduced to about 250 $\mu$m. At that point, the copper surface to be plated usually exhibits a high density of dislocations and grain boundaries. Plating such a surface results in a metallic combination characterized by microcracks and substantial interdiffusion between the plating and substrate materials, particularly at the elevated temperatures at which high-power X-ray target anodes operate. Such plated anodes typically exhibit undesirable variations in the character and intensity of X-rays emitted therefrom.

In accordance with this invention, the fine-machined copper surface to be plated is subjected to a series of polishing steps. First, the surface is rubbed with dry 400-grit silicon carbide paper, followed by rubbing with a wet paste of 400-grit silicon carbide applied with grit-free towelling. These steps remove a total of approximately 12-to-25 $\mu$m of the strip thickness and achieve a matte surface finish. Next, a total of about 5-to-15 $\mu$m is removed by rubbing with dry and then with wet French crocus paper, thereby to produce a dull surface finish. Subsequently, by utilizing a wet paste of 0.3-μm-size aluminum oxide particles on grit-free towelling, an additional 1-to-10 μm of the surface is rubbed off. Finally, a wet paste of 0.05-μm-size aluminum oxide is employed to remove about 0.2-to-2 μm of the strip thickness and to achieve a mirror surface finish.

At that point in applicant's process, the highly polished surface to be plated exhibits a relatively low density of grain boundaries. And, since substantial diffusion can occur at grain boundaries (relative to diffusion into the bulk substrate), reducing the grain boundary density has the effect of significantly reducing interactions between the copper substrate and the palladium layer to be plated thereon. In other words, in a plated member comprising a highly polished substrate of the type specified herein, most of the diffusion that does occur is of the bulk rather than of the grain boundary type. Signficantly, bulk diffusion for the particular metals considered herein is typically 10-to-100 times less than grain-boundary diffusion.

After the processing steps described above, it is generally advantageous to anneal the copper strip to relieve stresses introduced therein by the machining and polishing operations. Illustratively, this annealing step is carried out in a vacuum (about $10^{-5}$ Torr) for about one hour at approximately 300 degrees C.

After polishing and annealing, the substrate is mounted in a standard supporting jig which exposes only a specified surface portion to be plated. Advantageously, this surface portion is then hand polished for 5-to-10 minutes with a wet paste of 0.05-μm-particle-size aluminum oxide to remove any oxide that may have formed thereon. Next, the surface is treated with a standard degreasing agent, then dipped in a 10 percent solution of hydrochloric acid to further insure that any oxide has been removed. The surface is then rinsed in deionized water.

Subsequently, the clean copper substrate is immersed in a palladium plating bath maintained at approximately 51 degrees C. By way of example, one specific illustrative bath suitable for plating palladium on the aforedescribed substrate comprised the following constituents: 10-to-20 grams of palladium nitrate or palladium oxide (about 15 grams preferred), 8-to-24 grams of sodium nitrate (about 12 grams preferred), 30-to-60 grams of sodium phosphate (about 35 grams preferred), 5-to-20 grams of disodium ethylene dinitrilo tetra acetic acid (about 15 grams preferred), 1-to-4 grams of sodium sulfite (about one gram preferred), 5-to-40 grams of urea (about 20 grams preferred) and sufficient deionized water to make a one-liter bath.

In the described bath, a thin layer of palladium was initially flash plated on the copper substrate. Illustratively, this was done at a current density of approximately one milliampere per square centimeter for about 10 seconds. Then the current density in the bath was reduced to approximately 5-to-10 microamperes per square centimeter for 5-to-10 minutes. It has been found that this combination of steps achieves the plating of a palladium layer having a maximum thickness of about 0.1 μm. Significantly, the layer so plated is characterized by well-defined grains and low stress.

Next, the partially plated substrate was removed from the plating bath, rinsed in deionized water and then annealed in a vacuum (about $10^{31\,5}$ Torr) for about one hour at approximately 300 degrees C. During annealing, stresses in the palladium layer are relieved and adhesion between the layer and the underlying substrate is enhanced. Subsequently, the plated member was cleaned in a 10 percent solution of $NH_4OH$, repolished by hand with a wet paste of 0.05-μm-particle-size aluminum oxide, rinsed in a standard degreasing agent and then immersed again in the aforespecified plating bath. At the relatively low aforespecified current density of 5-to-10 microamperes per square centimeter, plating was resumed and continued for 2-to-6 hours to achieve a final overall palladium thickness in the 5-to-10 μm range. Lastly, it is advantageous to anneal the plated structure in a vacuum (about $10^{-5}$ Torr) for approximately 2 hours at about 300 degrees C. During this annealing step, some recrystallization of the palladium occurs and the density of grain boundaries at the palladium-to-copper interface is thereby reduced. As a result, diffusion across the interface during the lifetime of the structure is also reduced. In addition, the annealing relieves stresses in the palladium layer and thereby reduces the liklihood that cracks will develop therein during operation as a high-power target anode.

The above-described polishing, plating and annealing techniques are also directly applicable to the fabrication of a stationary plated-palladium target anode such as the conically shaped one described in the aforecited Maldonado application. In preparing such a conical anode, it has been found advantageous to initially polish the surface to be plated with diamond paste utilizing successively smaller diamond particles (for example, 3 μm particles, 1 μm particles and then 0.5 μm particles). Otherwise, the procedure specified for preparing the rotating anode also pertains to the stationary unit.

Finally, it is to be understood that the above-described arrangements are only illustrative of the principles of the present invention. In accordance with these principles, numerous modifications and alternatives may be devised by those skilled in the art without departing from the spirit and scope of the invention.

I claim:

1. A method of preparing a composite structure that comprises a metallic substrate having a metallic material plated thereon, said method comprising the steps of polishing a surface of said substrate to a mirror finish, flash plating onto said mirror-finish surface in a specified plating bath at a relatively high current density a relatively thin initial portion of the final desired thickness of said metallic material to be plated thereon, at a relatively low current density, continuing to plate said material in said bath by adding to said initial portion an intermediate portion of said same metallic material to achieve a thickness of said metallic material less than the final desired thickness, annealing the partially plated substrate to relieve stresses in the initial and intermediate portions of said plated material and to enhance adhesion between said portions and the substrate, and, at said relatively low current density, continuing to plate said same metallic material in said bath to achieve the final desired thickness, further comprising the step of annealing said substrate, subsequent to said polishing step, to relieve stresses due to polishing, and still further comprising the step of annealing said structure, subsequent to said plating steps, to relieve stresses in the plated layer and to reduce the density of grain boundaries at the layer-to-substrate interface, and wherein said substrate is made of a material selected from the group consisting of copper, gold and molybdenum, and wherein said plated layer is made of palladium.

2. A method of preparing a composite structure that comprises a metallic substrate having a metallic material plated thereon, said method comprising the steps of polishing a surface of said substrate to a mirror finish, flash plating onto said mirror-finish surface in a specified plating bath at a relatively high current density a relatively thin initial portion of the final desired thickness of said metallic material to be plated thereon, at a relatively low current density, continuing to plate said material in said bath by adding to said initial portion an intermediate portion of said same metallic material to achieve a thickness of said metallic material less than the final desired thickness, annealing the partially plated substrate to relieve stresses in the initial and intermediate portions of said plated material and to enhance adhesion between said portions and the substrate, and, at said relatively low current density, continuing to plate said same metallic material in said bath to achieve the final desired thickness further comprising the step of annealing said substrate, subsequent to said polishing step, to relieve stresses due to polishing, and still further comprising the step of annealing said structure, subsequent to said plating steps, to relieve stresses in the plated layer and to reduce the density of grain boundaries at the layer-to-substrate interface, and wherein said substrate is made of copper and said plated layer is made of palladium, wherein said composite structure is adapted to be utilized as a target anode in an X-ray lithographic system, and wherein said first-mentioned annealing step comprises annealing at about $10^{31\,5}$ Torr for about one hour at approximately 300 degrees C.

3. A method as in claim 2 wherein said relatively high current density is about one milliampere per square centimeter and said relatively low current density is about 5-to-10 microamperes per square centimeter.

4. A method as in claim 3 wherein said plating steps are carried out in a plating bath that comprises 10-to-20 grams of palladium nitrate or palladium oxide, 8-to-24 grams of sodium nitrate, 30-to-60 grams of sodium phosphate, 5-to-20 grams of disodium ethylene dinitrilo tetra acetic acid, 1-to-4 grams of sodium sulfite, 5-to-40 grams of urea and sufficient deionized water to make a one-liter bath.

5. A method as in claim 4 wherein said second-mentioned annealing step comprises annealing at about $10^{-5}$ Torr for about one hour at approximately 300 degrees C.

6. A method as in claim 5 wherein plating is continued to achieve a final overall palladium thickness in the 5-to-10 μm range.

7. A method as in claim 6 wherein said third-mentioned annealing step comprises annealing at about $10^{-5}$ Torr for about two hours at approximately 300 degrees C.

* * * * *